US005989076A

United States Patent [19]

Muzslay

[11] Patent Number: 5,989,076

[45] Date of Patent: Nov. 23, 1999

[54] MOLDED-IN CONNECTOR

[75] Inventor: Steven Zoltan Muzslay, Huntington Beach, Calif.

[73] Assignee: ITT Manufacturing Enterprises, Inc., Wilmington, Del.

[21] Appl. No.: 09/094,882

[22] Filed: Jun. 15, 1998

[51] Int. Cl.[6] ..... H01R 13/405

[52] U.S. Cl. ..... 439/736; 439/606

[58] Field of Search ..... 439/736, 606

[56] References Cited

U.S. PATENT DOCUMENTS

| | | | |
|---|---|---|---|
| 3,016,580 | 1/1962 | Jaeschke | 18/59 |
| 4,566,751 | 1/1986 | Yoshida et al. | 339/218 |
| 4,582,388 | 4/1986 | Swaffield | 439/606 |
| 4,795,602 | 1/1989 | Pretchel et al. | 264/272 |
| 4,871,331 | 10/1989 | Kondo et al. | 439/736 |
| 4,950,171 | 8/1990 | Muzslay | 439/76 |
| 4,959,027 | 9/1990 | Muzslay | 439/655 |
| 5,607,315 | 3/1997 | Bonnah, II et al. | 439/130 |

*Primary Examiner*—Michael L. Gellner
*Assistant Examiner*—Briggitte R. Hammond
*Attorney, Agent, or Firm*—Thomas L. Peterson

[57] ABSTRACT

A connector (30) that projects from a metal housing (12), is formed by molding plastic in place, and is braced to increase its strength against breakoff. A cavity (32) is formed in the housing with an undercut that forms an inwardly-facing cavity shoulder (54). A metal brace (70) projects from inside the cavity to outside the cavity, and plastic is molded to lie inside and outside the cavity and to be strengthened by the metal brace. The brace is in the form of a sleeve with a flange (74) that abuts the inwardly-facing undercut cavity shoulder (54), so forces applied to the molded connector are transmitted through the metal brace directly to the walls of the metal housing.

5 Claims, 2 Drawing Sheets

MOLDED-IN CONNECTOR

BACKGROUND OF THE INVENTION

A new diesel fuel injection system developed by applicant required an interconnect system to be integrated with the metal injector housing. The connector had to be highly reliable, sealed from the environment, and able to withstand high impact and random vibrations that might be as high as 28 G's. One approach is to cut a cavity into a side of the metal housing, place a mold around the cavity with a contact and wire extending through the mold, and injecting or otherwise introducing a polymer into the mold to be set. However, the strength of molded polymers is about one to two orders of magnitude less than that of commonly used metals such as steel, so there is a danger that the molded plastic housing will not withstand large forces that could break it off from the housing. A connector which could be molded to a metal housing, but which had a high strength against breakoff, would be of value.

SUMMARY OF THE INVENTION

In accordance with one embodiment of the present invention, a housing and connector assembly is provided, wherein the connector assembly is molded of a polymer but is reinforced against breakoff. A surface area of the housing is formed with a cavity therein that opens in a predetermined outward direction. A connector frame is attached to the housing by molding it in place so some of the molded polymer lies in the cavity and some lies outside the cavity and forms a connector, a contact being molded into the molded connector. The connector frame includes a metal brace with an inner part lying in the cavity and an outer part projecting out of the cavity, and a molded polymer lying around both parts of the brace. The cavity is formed with an undercut that results in a primarily inwardly-forming shoulder. The brace has a flange that abuts the shoulder to prevent pullout of the brace. Forces applied to the projecting part of the frame are transmitted through the metal brace and from its flange to the inwardly-facing shoulder of the metal housing. A relatively small area of contact between the brace flange and the inwardly-facing shoulder of the metal housing, can withstand concentrated forces that might otherwise break the molded polymer.

The brace is preferably formed from a metal tube with a flange at one end. The tube is formed from sheet metal and has spaced edges that extend largely parallel to the axis of the tube. The flange end of the tube is installed in the undercut cavity by compressing the tube to bring its edges close together so the flange fits into the cavity. Then the tube is released to expand, so its flange can abut the inwardly-facing shoulder formed by the undercut cavity.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
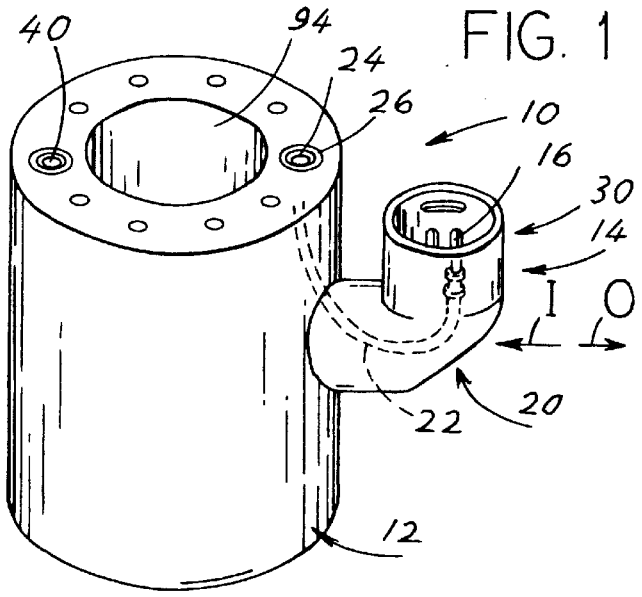
FIG. 1 is an isometric view of a housing and connector assembly constructed in accordance with the present invention.

FIG. 1 illustrates a housing and connector assembly 10 which includes a metal fuel injector housing 12 that is formed of rigid material such as machined stainless steel or other metal, and a molded connector frame 14 that is molded of a polymer such as a high strength injection molded plastic. A first contact 16 lying in the vicinity of a first location 20 on the frame is connected by a wire 22 to a second contact 24 lying at a second location 26. The fuel injector housing 12 is of a shape that has been previously used. The connector 30, that includes the molded connector frame 14 and contact 16, is mounted on the previously known housing 12.

Figure 2A:
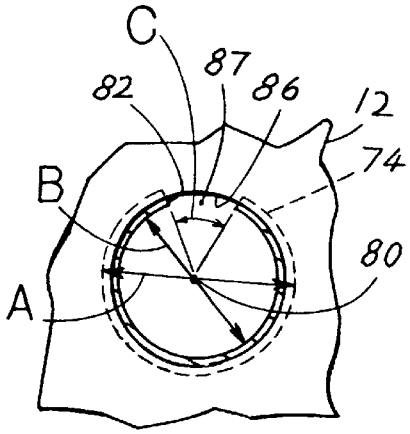
FIG. 2A is a view taken on line 2A—2A of FIG. 2, but before the connector housing is molded in place.
Figure 2:
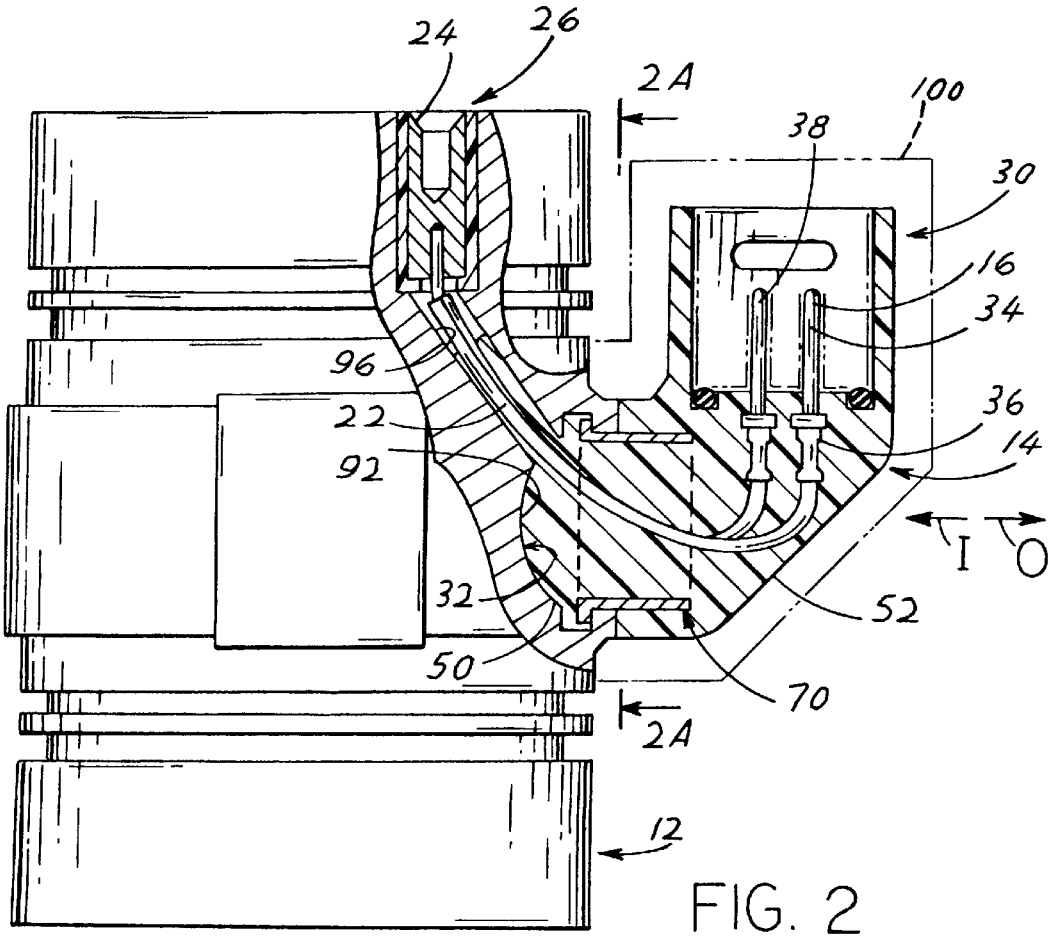
FIG. 2 is a side elevation view, with a portion in section, of the housing and connector assembly of FIG. 1.
Figure 3:
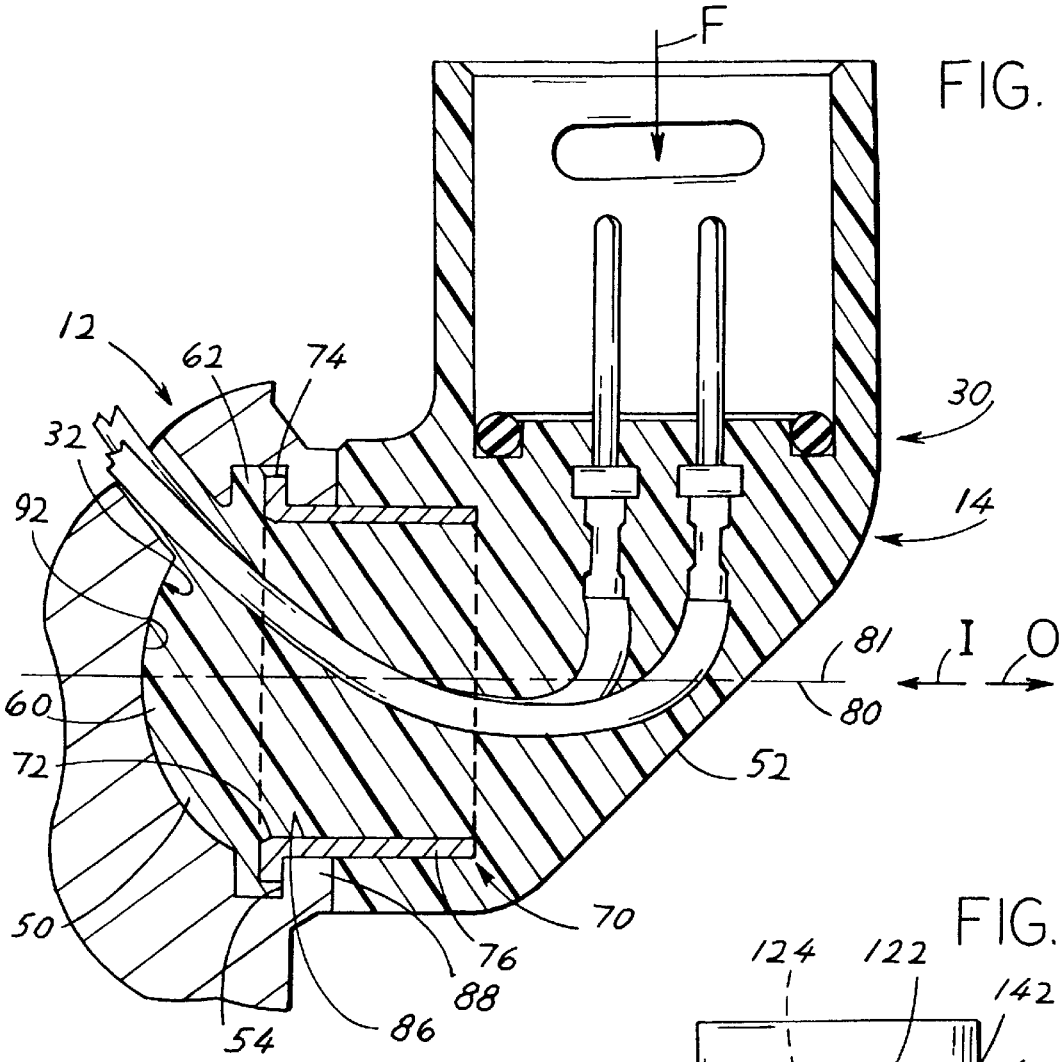
FIG. 3 is an enlarged sectional view of a portion of the housing and connector assembly of FIG. 2.

As shown in FIG. 2, the housing 12 is formed with a cavity 32 in which the connector frame 14 is anchored. The cavity is formed in a side of the housing 12 and faces in an outward direction 0 out of the housing. The first contact 16 has a mating end 34 that can be mated to another connector, and has an opposite embedded end 36 that is embedded in the connector frame 14 and that connects to the wire 22. It is noted that the connector 30 includes an additional pin contact 38 that is connected through another wire to another contact 40 on the metal housing. The connector frame 14 includes an inner quantity 50 of molded polymer material that lies in the housing cavity 32, and an outer quantity 52 that lies outside the cavity. As better shown in FIG. 3, the cavity is undercut, in that it forms a largely inwardly-facing shoulder 54. It would be possible to rely solely on the strength of the plastic material of the connector 14 to prevent breakoff of the connector 14 from the metal housing 12. However, if a force is applied perpendicular to the inward and outward directions I, O, then even a moderately high level of force may cause breakage of the connector frame 14. For example, a large downward force in the direction F would cause compression of the lower part 60 of the inner quantity 50 of molded material and tension and shear forces at an upper location 62 which can cause the upper location 62 to break away from the rest of the molded connector frame.

In accordance with the present invention, applicant includes a metal brace 70 to transmit some of the forces between the outer quantity 52 of molded material and the walls of the cavity. This reduces forces on a part such as 62 of the inner quantity of molded material, that could break off because of high tension and shear forces when a force F is applied to the outside of the connector housing perpendicular to the inward and outward directions. The brace is preferably in the form of a tube with an inner part 72 that lies within the cavity and that has a tube flange 74 that lies substantially against the inwardly-facing shoulder 54 formed on the metal housing 12 as a result of the cavity being undercut. It noted that a small amount of the molded material can lie between the flange and shoulder, although direct contact is preferred. The tube also includes an outer part 76 that extends in the outward direction O to lie outside the cavity. The tube has an axis 80 that is preferably coincident with the cavity axis 81. An external force such as F applied to the outer quantity of the material 52 of the connector frame 14 is transmitted to the outer part 76 of the metal tube 70, and is transmitted through the tube outer part 76 to the tube inner part 72 and to the tube flange 74. The flange 74 presses against the shoulder 54 to transmit concentrated forces thereat. Since engineering metals such as steel or copper have a strength that is one to two orders of magnitude greater than that of engineering plastics, the metal tube can withstand large concentrated shear and tension forces that might cause plastic material to fail.

Figure 4:
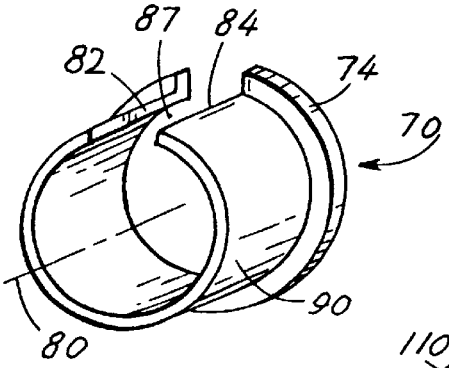
FIG. 4 is an isometric view of the tubular brace of the assembly of FIG. 3.

FIG. 4 shows the initial shape of the metal bracing tube 70. The tube is formed from a piece of sheet metal that has been plastically deformed to form the flange 74, and which has been bent into a largely cylindrical shape about a tube axis 80. The sheet metal is rolled so adjacent edges 82, 84 of the tube are spaced apart as by an angle of 90°, depending upon the radial length of the flange 74. The tube is constructed to when it is compressed to bring the edges 82, 84 together, the flange 74 fits through the radially inside surface 86 of a radially inwardly-extending flange 88 formed in the metal housing immediately forward of the shoulder 54. The tube then expands because of its springiness. Preferably, the inside 86 of the housing cavity entrance is of slightly smaller diameter than the outside 90 (FIG. 4) of the tube in its uncompressed state, so the tube is slightly compressed by the housing flange 88. This results in the tube lying in a stable position in the housing.

The flange 74 preferably has an outside diameter A (FIG. 2A) that is no more than 20% greater (and preferably no more than 15% greater) than the outside diameter B of the tube at the entrance to the cavity (the same applies for the radii). This allows insertion of the flange with a smaller angle C of the gap 87 for the fully installed tube, where the assembly is slightly weakened.

To form the housing and connector assembly 10, applicant first bores out the cavity 32 in the housing 12. The cavity preferably has a largely spherical inner surface 92, so the cavity does not extend inwardly far. This is necessary because, as shown in FIG. 1, the housing 12 has a large central bore 94, so the cavity cannot extend too far into the housing. In addition, a passage 96 (FIG. 2) is formed in the housing to pass the wire 22 that will connect the second contact 24 to the first one 16. With the second contact 24 in place, the wire 22 is threaded through the hole and crimped to the first contact 16. Then, a mold indicated at 100, is placed outside the cavity 32 and around the bracing tube 70, and with the mating end 34 of the first contact held in place by the mold. A polymer is injected into the mold to fill the cavity 32, the inside of the tube 70, and the rest of the area within the mold to form the connector frame of the shape illustrated. The polymer lies around the tube inner part (not necessarily completely around it) and tube outer part as well as lying in the tube. The mold is then removed, and the combination of the housing and connector assembly results.

Figure 5:
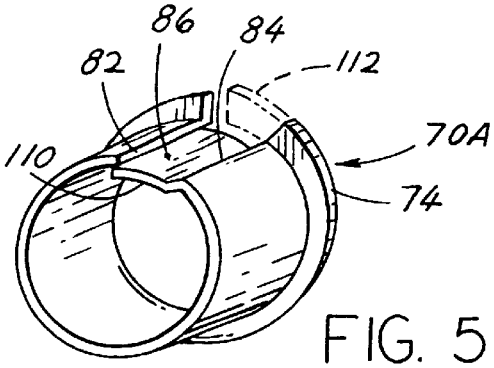
FIG. 5 is an isometric view of a tubular brace of another embodiment of the invention, which can be used in the assembly of FIG. 3.

FIG. 5 shows another bracing tube 70A that is somewhat modified from that of FIG. 4. The tube 70A is provided with an extension 110 that extends from the edge 84 to beneath the edge 82. This still leaves the gap 87 between the edges 82, 84. A similar extension, indicated at 112 that can snap to a position coplanar with the rest of the flange, can be provided for the flange 74. However, both of the extensions 110, 112 are generally not needed.

Figure 6:
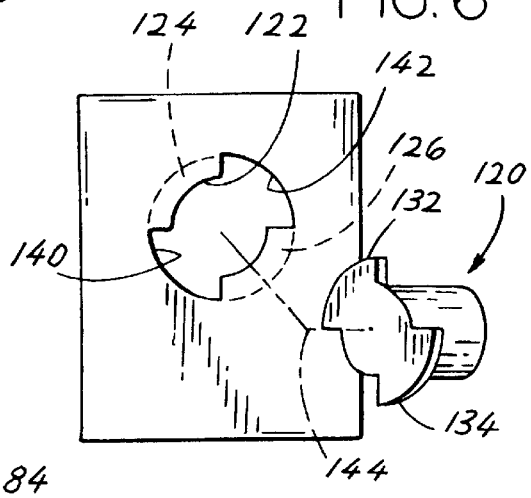
FIG. 6 is an exploded isometric view of a housing and metal brace constructed in accordance with another embodiment of the invention.

FIG. 6 illustrates another form of brace 120 that can be inserted into a specially formed cavity 122 that is undercut in that it forms inwardly-facing shoulders at 124 and 126. The brace has flanges 132, 134 that can abut the shoulders 124, 126. The brace 120 is installed by inserting the flanges 132, 134 through gaps 140, 142, and then turning the brace 120 by 90° about its axis 144. Although the brace 120 could be used, it is not preferred, especially because it does not have flanges at the gaps 140, 142 to prevent breakoff of the connector frame, although this disadvantage can be avoided by using perhaps four 45° flanges and four corresponding gaps.

Thus, the invention provides a housing and connector assembly wherein the connector assembly projects outwardly from the housing, which includes a brace that is easily installed and that increases the strength of the connector frame against breakoff from the housing. A cavity is formed in the housing, with the cavity being undercut to form a largely inwardly-facing shoulder. A metal brace is inserted into the cavity, with a flange that abuts the largely inwardly-facing shoulder, the brace having a portion that projects outwardly out of the cavity. The connector frame is molded so one quantity of polymer lies within the cavity and against the brace portion that lies within the cavity, and another portion of the polymer lies outside the cavity and against the outwardly-projecting portion of the brace. The brace is preferably formed from a piece of sheet metal that has been bent into a largely tubular shape, with a flange at one end that is to be inserted into the cavity. The adjacent edges of the bent tube are spaced apart, so they can be pushed together to insert the flange into the cavity, and then spring apart to hold the tube in position while material is molded into and around the tube.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A housing and connector assembly, comprising:

a housing of rigid material;

an electrical contact;

a connector frame that is attached to said housing with said contact in said connector frame;

said housing having a cavity which opens in a predetermined outward direction out of said housing, said cavity being undercut to form a primarily inwardly-facing shoulder;

a metal brace with an inner part lying in said cavity and an outer part projecting out of said cavity, said brace inner part having walls substantially abutting said shoulder to prevent pullout of the brace;

said connector frame including a quantity of polymer material which is molded so part of said connector frame lies in said cavity and around said brace inner part, and part of said connector frame lies outside said cavity and around said outer part of said brace and surrounds part of said first contact to fix a position of said first contact relative to said housing.

2. The assembly described in claim 1 wherein:

said cavity has a cavity axis and forms a radially inwardly-extending housing flange;

said brace comprises a metal tube with a tube axis that is substantially coincident with said cavity axis, said tube having an inner end forming a radially outwardly-extending tube flange that lies inward of and substantially against said shoulder.

3. The assembly described in claim 2 wherein:

said tube comprises a piece of resilient sheet metal that has been bent into a tubular shape, with said tube flange and with adjacent edges near said tube flange extending primarily parallel to said tube axis;

said adjacent edges near said tube flange being spaced apart in an undeflected tube configuration so when said tube is compressed until said edges abut each other, said tube flange can pass along said cavity axis beyond said shoulder with said tube then expanding, when released, to a configuration against said shoulder wherein said edges are spaced by less than their spacing in an undeflected configuration.

4. The assembly described in claim 3 wherein:

said tube has a largely cylindrical part, and said flange extends radially outwardly by no more than 20% of the radius of said cylindrical part.

5. A housing and connector assembly, comprising:

a metal housing having an outwardly-facing surface with an undercut cavity therein that forms a primarily inwardly-facing shoulder;

a sheet metal tube that has an axis and that has an inner end forming a radially outwardly-extending flange that lies against said inwardly-facing shoulder, said tube having an outer portion that projects out of said cavity;

a quantity of molded plastic that includes a first plastic portion that lies in said cavity and that holds said tube flange substantially against said inwardly-facing shoulder, an integral second plastic portion that lies within said tube and that substantially fills said tube, and a third plastic portion that lies around said tube outer portion;

an electrical contact fixed in position by said molded plastic;

a wire electrically connected to said contact and extending through said tube into said cavity.

* * * * *